US006527116B1

(12) United States Patent
Gale

(10) Patent No.: US 6,527,116 B1
(45) **Date of Patent: *Mar. 4, 2003**

(54) SHIPPING CARTON FOR GLASS BOTTLES AND PULP INSERTS FOR USE THEREIN AND COMBINATION THEREOF

(75) Inventor: Gregory W. Gale, Napa, CA (US)

(73) Assignee: Regale Corporation, Napa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/306,516

(22) Filed: May 6, 1999

Related U.S. Application Data

(63) Continuation-in-part of application No. 08/882,737, filed on Jun. 26, 1997, now Pat. No. 5,975,300, which is a continuation of application No. 08/648,769, filed on May 16, 1996, now abandoned.

(51) Int. Cl.[7] ..... B65D 65/00

(52) U.S. Cl. ..... 206/427; 206/433; 206/592; 220/514

(58) Field of Search ..... 206/427, 433, 206/446, 591, 592, 521, 594; 220/510, 513, 514, 516, 517, 518

(56) References Cited

U.S. PATENT DOCUMENTS 641,207 A * 1/1900 Higham ..... 206/521
1,601,547 A * 9/1926 Wofford ..... 206/521
2,216,339 A * 10/1940 De Reamer ..... 206/427
2,547,005 A * 4/1951 Herrick et al. ..... 206/521
5,038,961 A * 8/1991 Watanabe et al. ..... 220/519

FOREIGN PATENT DOCUMENTS

FR 1474782 * 12/1965 ..... 206/433

* cited by examiner

*Primary Examiner*—Shian Luong
(74) *Attorney, Agent, or Firm*—Dorsey & Whitney LLP

(57) ABSTRACT

A combination of a carton and a plurality of containers. The carton comprises side walls and end walls to form a four-sided enclosure having a bottom side and a top side. The side walls and the end walls have major and minor bottom flaps which form a bottom wall closure extending over the bottom side. The second side walls and the end walls have major and minor top flaps which form a top closure to provide a six-sided enclosed space. A first insert is disposed in the enclosed space and extends over the bottom closure and is supported by the bottom closure. A plurality of containers is disposed within the enclosed space and engages the first insert. A second insert overlies and engages the containers. The first and second inserts engage the tops and bottoms of the containers for retaining the containers in spaced-apart positions out of engagement with each other and in spaced-apart positions with respect to the first and second side walls and first and second end walls thereby preventing engagement of the containers with respect to each other and with respect to the first and second side walls and the first and second end walls of the carton during movement of the carton with the containers therein. The second insert is formed into two half sections which are cooperatively and removably secured to the top minor flaps and move with the top minor flaps.

14 Claims, 6 Drawing Sheets

SHIPPING CARTON FOR GLASS BOTTLES AND PULP INSERTS FOR USE THEREIN AND COMBINATION THEREOF

This application is a continuation-in-part of application Ser. No. 08/882,737 filed on Jun. 26, 1997, now U.S. Pat. No. 5,975,300 which is a continuation of application Ser. No. 08/648,769 filed on May 16, 1996 now abandoned.

This invention relates to a shipping carton for glass bottles and pulp inserts for use therewith and a combination thereof.

Shipping cartons have heretofore been provided for glass containers such as wine bottles. Typically such containers have utilized corrugated or chipboard partitions inside the containers to provide support and prevent contact of the containers or bottles with each other. The use of such vertical partitions has a number of disadvantages. Scuffing of the labels carried by the bottles occurs because of the labels contacting the partitions and the box interior during motion of the carton during transportation of the same from one location to another. Such vertical partitions generally require assembly before placement in the cartons thereby increasing the cost for packaging. There is therefore a need for a new and improved shipping carton which overcomes these disadvantages.

In general, it is the object of the present invention to provide a shipping container for glass bottles which makes it possible to eliminate the use of vertical partitions within the carton.

Another object of the invention is to provide a shipping container which has inserts therein which engage the bases of the bottles and the necks of the bottles to maintain spacing between the bottles so that the labels carried by the bottles do not come in contact with each other or with the carton and thereby eliminating scuffing of the labels.

Another object of the invention is to provide a shipping carton and inserts of the above character in which the inserts are carried by the minor flaps of the shipping carton.

Another object of the invention is to provide a shipping carton and inserts for use therewith in which the shipping carton can be automatically erected and the inserts incorporated therein by case erecting machinery.

Another object of the invention is to provide an insert of the above character which can be utilized for seating of both the bases and the necks or tops of the glass bottles with the inserts being interchangeable for either the tops or the bases of the bottles.

Another object of the invention is to provide a shipping container and inserts for use therewith which reduce packaging costs.

Another object of the invention is to provide inserts of the above character which can be formed utilizing recycled paper pulp.

Another object of the invention is to provide an insert of the above character that is significantly lighter in weight and contributes less dust.

Additional objects and features of the invention will appear from the following description in which the preferred embodiments are set forth in detail in conjunction with accompanying drawings.

In general the carton incorporating the present invention is for use with glass bottles and has first and second spaced-apart parallel side walls, first and second spaced-apart parallel end walls adjoining the side walls and extending at right angles thereto and forming a rectangular enclosure with top and bottom open ends. First and second minor bottom flaps are provided which adjoin respectively the first and second end walls and are folded inwardly over the bottom open end. First and second major bottom flaps are provided adjoining respectively the first and second side walls and are folded inwardly over the bottom open end and over the first and second minor flaps and are bonded to the minor flap to form a bottom closure for the bottom opening. First and second minor top flaps are provided adjoining respectively the first and second end walls and are folded over the top open end. First and second major top flaps are provided adjoining respectively said first and second side walls and are folded inwardly over the top open end and over the first and second minor flaps and are bonded to the first and second minor flaps to form a top closure for the top opening whereby an enclosed space is provided. First and second inserts are disposed in the enclosed space with one of the inserts being located adjacent to the bottom and the other inserts located adjacent to the top end. Each of said inserts has pairs of concentric or inner recesses or wells and in which each pair consists of a center or inner recess or well adapted to receive the top of the bottle and an outer recess or well adapted to receive the bottom or base of the bottle whereby the inserts can be utilized for retaining the bottles in the carton in spaced-apart positions to prevent the bottles from coming into contact with each other and the side walls of the container. The inserts can be separated into two parts which can be secured to the minor flaps of the carton.

Figures 1, 2:
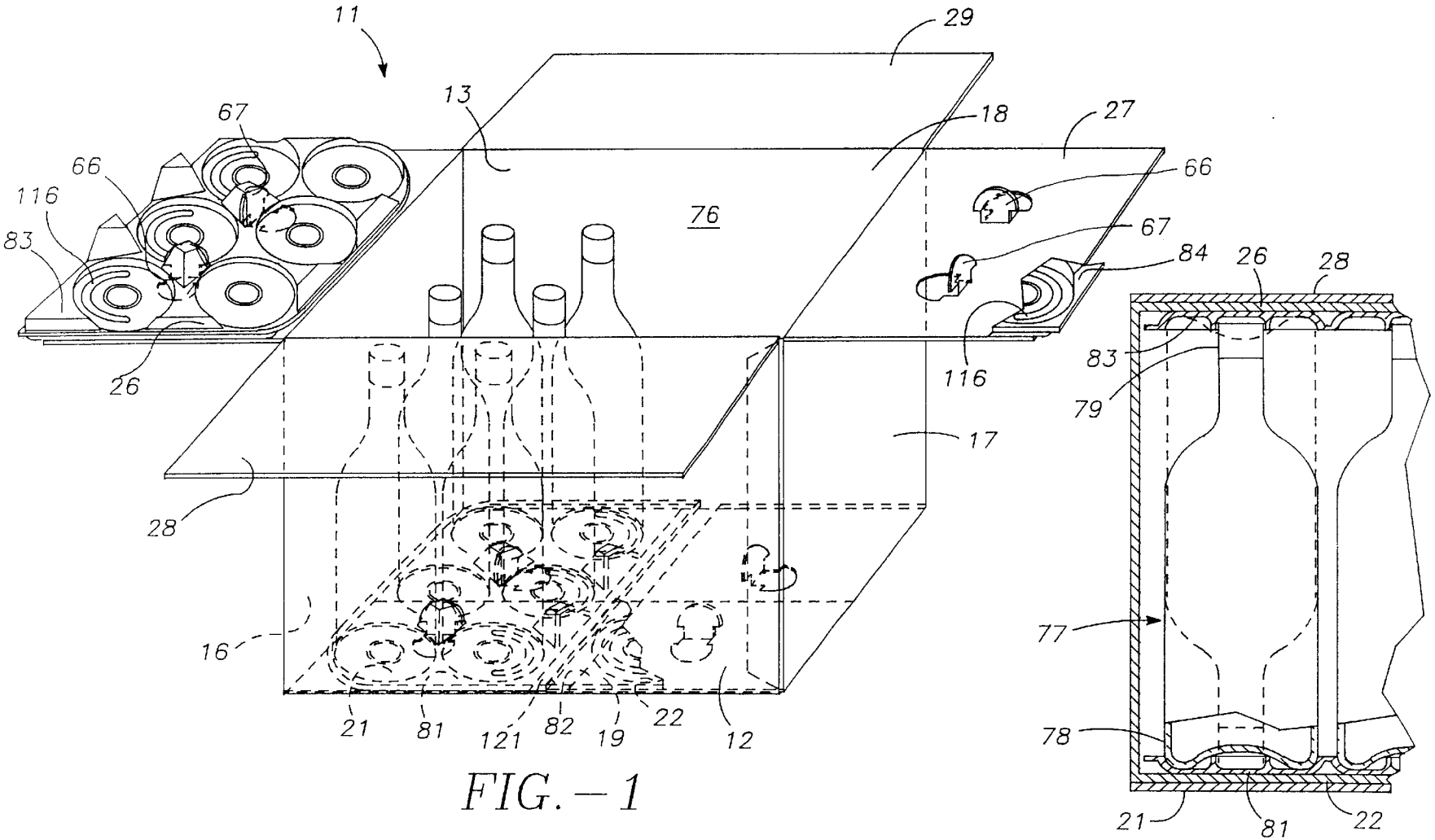
FIG. 1 is an isometric view of a shipping carton incorporating the present invention having pulp inserts carried by the miner flaps and showing wine bottles packed therein.
FIG. 2 is a partial side-elevational view in cross-section of the carton shown in FIG. 1 with the top closure in place showing how bottles can be shipped either right side up or right side down without changing the inserts.

More in particular as shown in FIGS. 1 and 2 of the drawings, the carton 11 incorporating in the present invention as shown in FIG. 1 consists of first and second side walls 12 and 13 which are spaced apart and parallel and first and second end walls 16 and 17 which are spaced apart and parallel and which adjoin the side walls 12 and 13 and extend at right angles thereto to form a rectangular enclosure having a top and bottom open ends 18 and 19. The carton 11 also consists of first and second minor bottom flaps 21 and 22 which adjoin respectively the first and second end walls 16 and 17 and as shown in FIG. 1 are folded inwardly over the bottom end 19. It also consists of first and second major bottom flaps 23 and 24 which adjoin respectively the first and second side walls 12 and 13 and which are folded inwardly over the bottom end 19 and over the first and second minor bottom flaps and are bonded thereto by suitable means such as an adhesive (not shown in FIG. 1) to form a closure for the bottom end. The carton also consists of first and second minor top flaps 26 and 27 respectively adjoining the end walls 21 and 22 which are folded over the top end 18. First and second major top flaps 28 and 29 are provided which adjoin respectively the first and second side walls 12 and 13 which are folded inwardly over the top open end and over the first and second minor top flaps 26 and 27 and bonded to the first and second minor top flaps to form a closure for the top opening 18 whereby there is provided and enclosed six-sided space.

A carton blank 31 for forming the carton 11 is shown in FIG. 2 in which the components hereinbefore described are shown. The blank 31 can be formed of a suitable material such as a corrugated board. The molded pulp or molded fiber which is utilized for making the inserts is typically made out of a mixture of newspaper which has been added to hot water with a touch of alum to balance the pH in the water. Other fibrous materials such as leather, plants and the like can be used. If a brown or off-white color is desired for the molded pulp inserts, this can be accomplished by adding recycled corrugated board from containers. Desired coloring also can be achieved by the use of dyes.

Technically such a corrugated board is made from three rolls of paper in which the two outer sheets called liners and the middle sheet is corrugated to provide the medium which are bound into a unitary structure by use of steam and cornstarch. This corrugated board is cut into the blank 31 by the use of conventional machinery which provides score lines and slots as shown.

Thus as shown in FIG. 2 there is provided a central portion 32 and top and bottom side portions 33 and 34. The central portion includes side 1 and side 2 previously identified as sidewalls 12 and 13 and ends 1 and 2 previously identified as end walls 16 and 17. The side portion 33 includes the minor flaps 21 and 22 and the major flaps 23 and 24 whereas the side portion 34 includes the minor flaps 26 and 27 and the major flaps 28 and 29.

As shown, the blank 31 has been scored to provide a first fold line 36 formed by scoring extending between side 1 and end 1, a second fold line extending between end 1 and side 2 and a third fold line 38 extending between side 2 and end 2. The central portion 32 also includes a tab 41 adjoining the end 2 with a fourth fold or score line 42 extending between the tab 41 and the end 2.

With respect to the side portion 33, the bottom major flaps 23 and 24 with respect to sides 1 and 2 are provided with fourth and fifth fold lines 42 and 43. Similarly, the minor bottom flaps 21 and 22 adjoining the ends 1 and 2 have sixth and seventh fold lines 46 and 47 extending between the same. Similarly, the other side portion 34 for the major flaps 28 and 29 adjoining sides 1 and 2 is provided with eighth and ninth fold lines 48 and 49 and the minor top flaps 26 and 27 adjoining the ends 1 and 2 are provided with tenth and eleventh fold lines 51 and 52 extending between the same. In the side portion 33, a first slot 56 is provided in the blank 31 which extends between the major flap 23 and the minor flap 21 and a second slot 57 which extends between the minor flap 21 and the major flap 24 and another slot 58 extends between the major flap 24 and the minor flap 22. Similarly, with respect to the other side portion 34 a fourth slot 61 extends between the major flap 28 and the minor top flap 26, a fifth slot 62 extends between the minor top flap 26 and major top flap 29 and a sixth slot 63 extends between the major flap 29 and the minor flap 27.

At least one lock tab and preferably two lock tabs are provided in each of the minor flaps in the blank 31. As shown, first and second lock tabs 66 and 67 are provided in each of the minor flaps as shown with the first lock tab and second lock tab 66 and 67 extending at right angles to each other. Each lock tab 66 and 67 is provided with a stem 68 and a mushroom-like cap 69 to provide a mushroom-shaped lock tab which has been die cut into the minor flaps. Each lock tab 66 and 68 remains coupled to the associated minor flap by a fold line 71 extending at right angles to the base of the stem 68. The configuration of the lock tabs 66 and 67 are identical with the exception that one extends at right angles with respect to other on each flap. The lock tabs 66 and 67 are formed in such a manner so that they can be pressed out of the plane of the minor flap and bent or folded so that they extend in a direction which is at right angles to the plane of the flap as shown in FIG. 1.

In order to provide the carton which is shown in FIG. 1, it is necessary to fold the carton blank shown in FIG. 2 along the hereinbefore identified fold lines and then folding the tab 41 so that it extends over the adjoining side wall and bonding the same thereto by suitable means such as an adhesive (not shown). The top and bottom ends 18 and 19 can then be closed by folding the first end with the minor flap followed thereafter by the major flaps which major flaps can be bonded to the minor flap by suitable means such as staples and the like. The carton 11 can be erected manually as hereinbefore described or can be erected mechanically by carton erecting machinery to provide a carton which has an interior six-sided space 76 therein.

First and second half inserts 81 and 82 are secured to the first and second minor bottom flaps 21 and 82 and similarly third and fourth half inserts 83 and 84 are secured to the top minor flaps 26 and 27 (see FIG. 1).

The six-sided enclosed space 76 in accordance with the present invention with the half insert therein is adapted to receive a plurality of bottles 77 for shipment as shown in FIG. 1 with the bottles typically being made of glass and having a cylindrical bottom or base 78 and a tapered neck or top 79. Each half insert is identical and thus only one half insert will be described in detail.

Half insert 81 is formed of a substantial planar sheet of material 86. The material can be of any suitable type. For numerous reasons, it is desirable to utilize non-plastic materials such as pulp from reclaimed paper products such as newspaper and corrugated cardboard for this material.

The sheet material 86 is provided with first and second or upper and lower surfaces 87 and 88 which are substantially parallel to each other. A plurality of cups or wells 91 are formed in the sheet material 86 and extend downwardly from the first surface and are defined by a generally vertical but slightly inclined side walls 92 with bottom walls 93 to provide cups or wells 91 facing upwardly through the first surface 87 and with the exterior thereof facing downwardly from the second surface 88.

Figure 3:
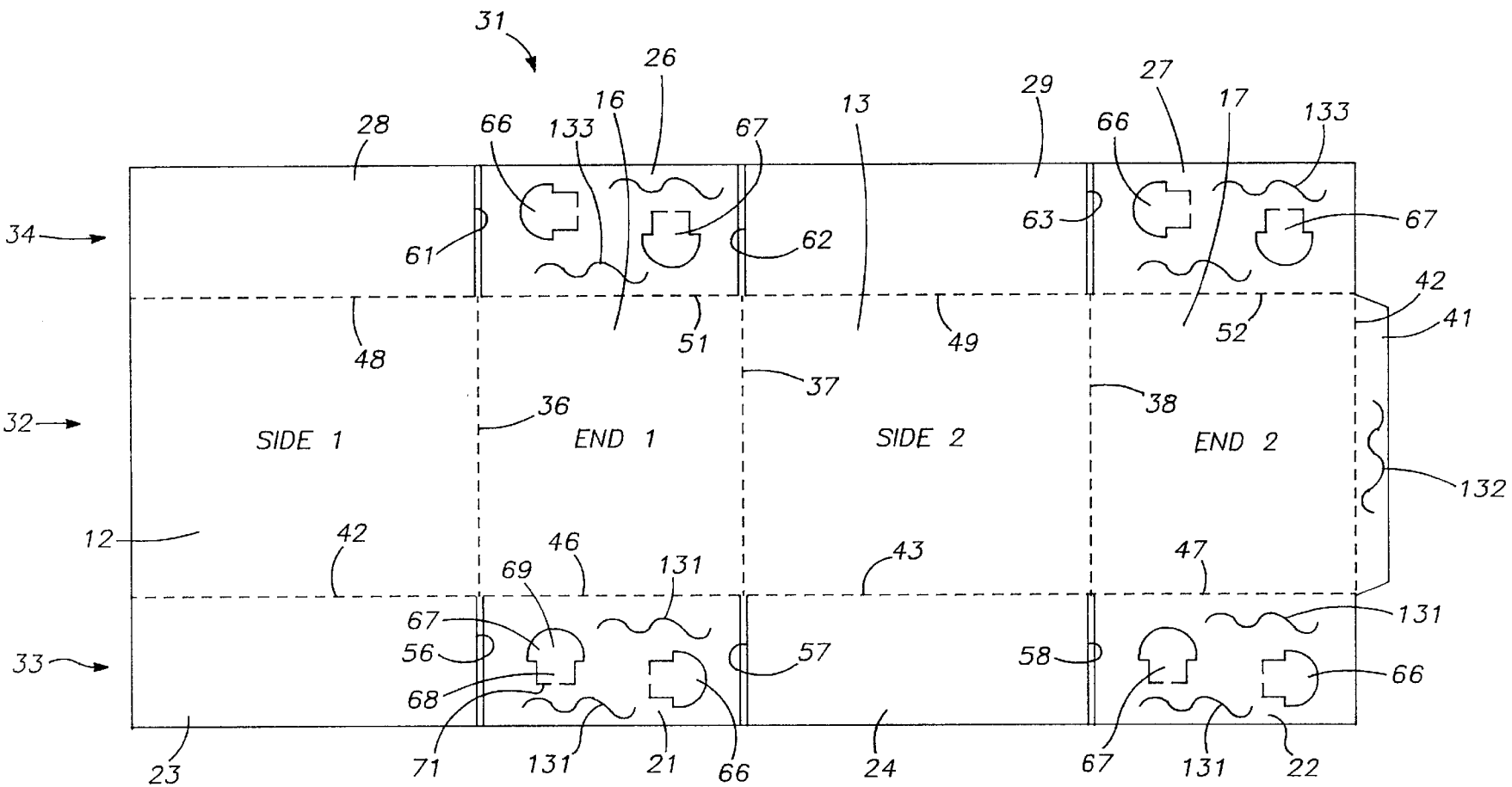
FIG. 3 is a plan view of a carton blank utilized for making the carton shown in FIG. 1.
Figure 4:
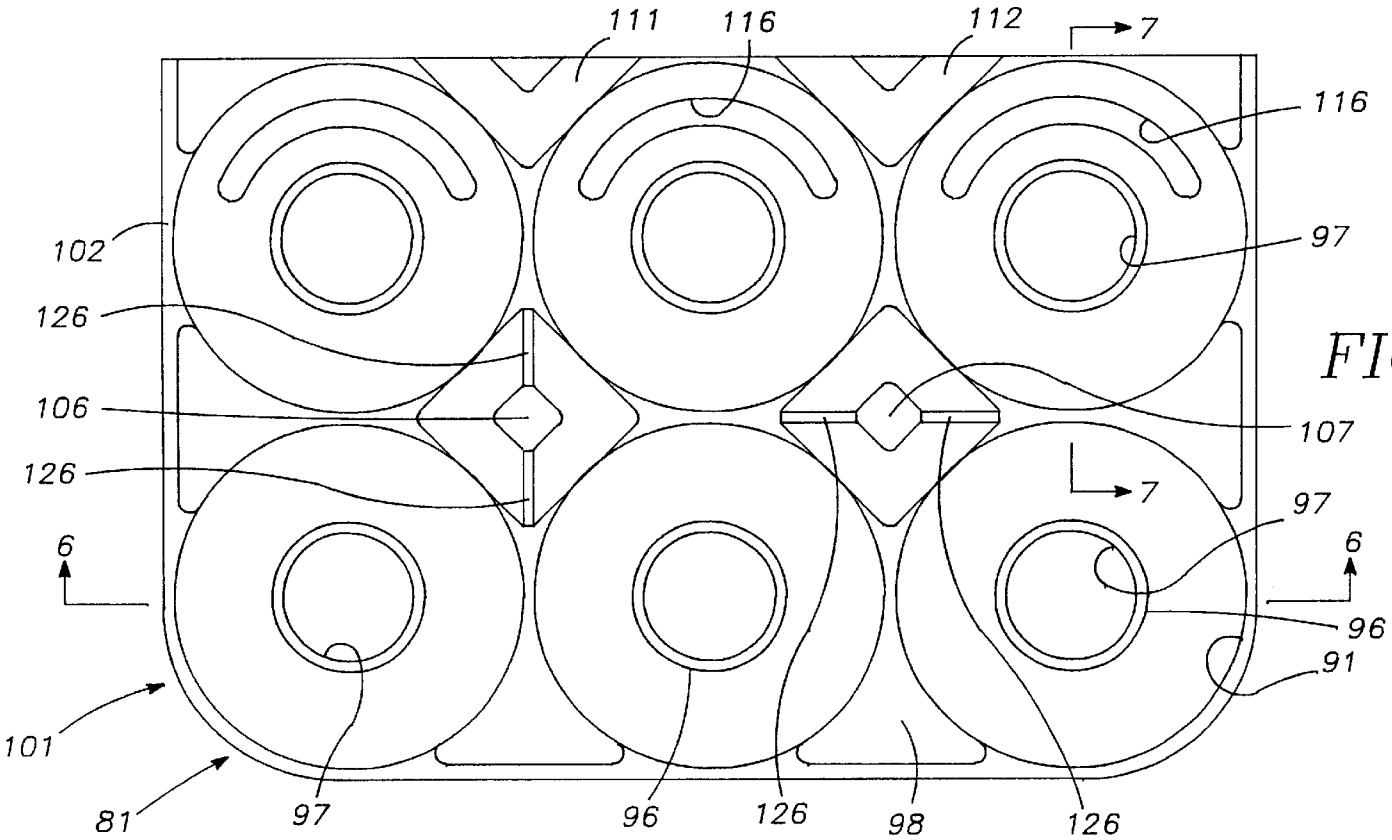
FIG. 4 is a top plan view of one of the inserts shown in FIG. 1.
Figure 6:
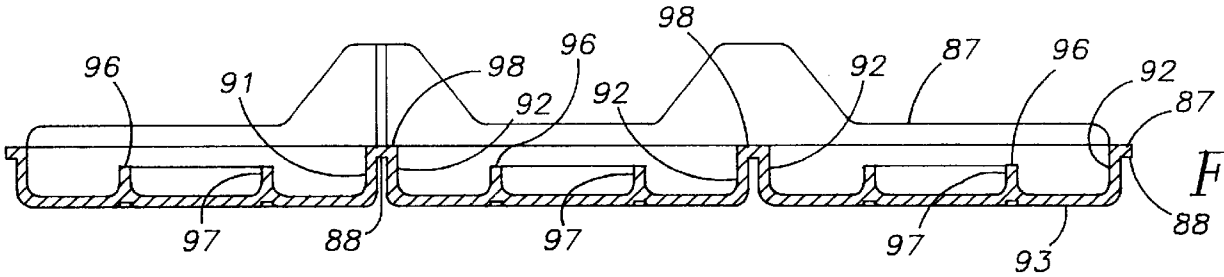
FIG. 6 is cross-sectional view taken along the lines 6—6 of FIG. 4.

The cups or wells 91 are sized so that they are adapted to receive the bases or bottoms of the bottles 77 hereinbefore described. The cups or wells 91 are arranged in rows extending in two different directions and extending at right angles to each other. Thus as shown in FIG. 3, there are provided six wells which are arranged in two rows of three wells in one direction and three rows of two wells at right angles to the first direction.

Figure 5:
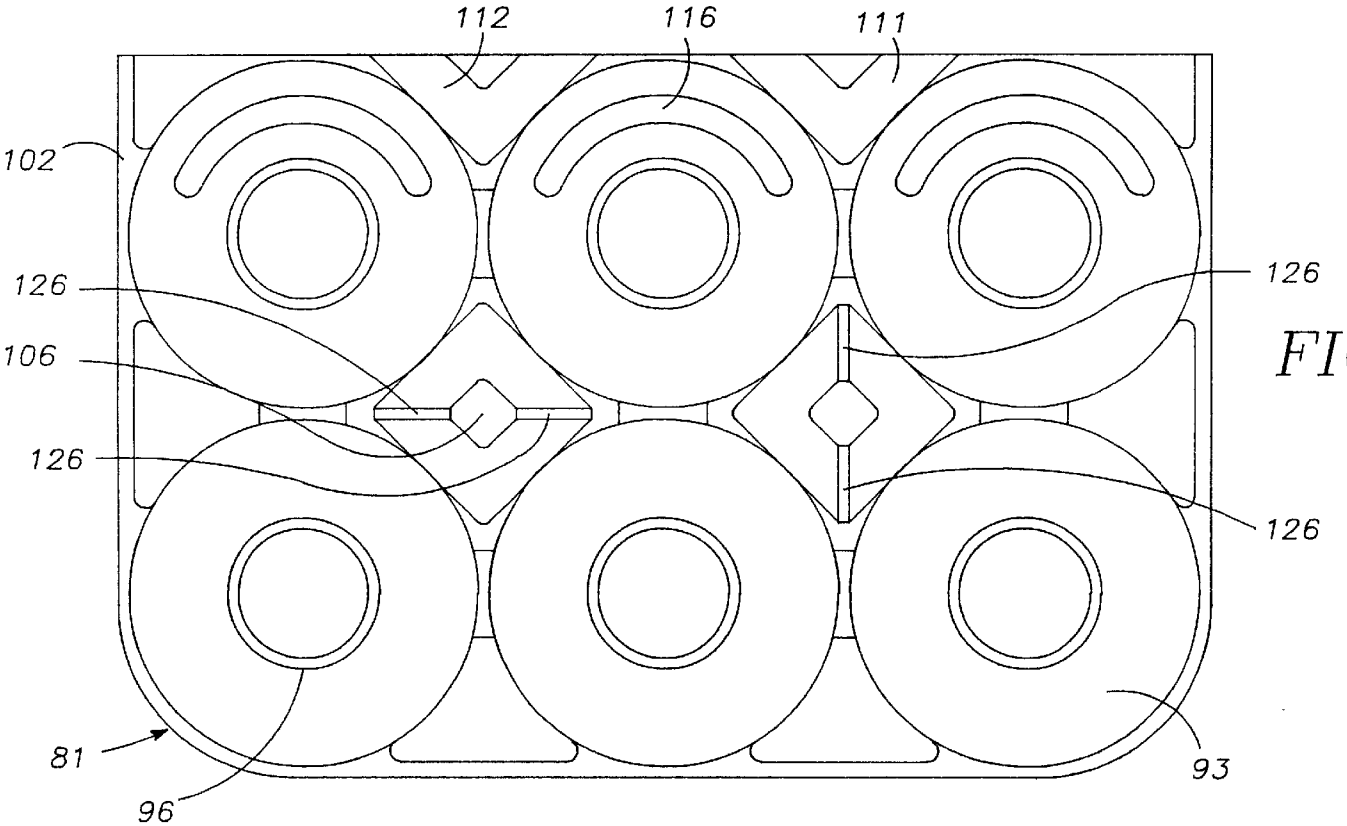
FIG. 5 is a bottom plan view of the insert shown in FIG. 3.

Each of the cups or wells 91 is provided with an upstanding cylindrical rib 96 which is concentric with the side wall 92. The rib 96 is centrally disposed within the well 91 and is spaced from the side wall 92. The cylindrical rib 96 has a diameter which is substantially less than the diameter of the well 91 and provides a cylindrical recess 97 that is sized so that it is adapted to receive the neck or top 79 of a bottle 77. The cups or wells 91 are spaced a suitable distance apart so that the sides of the bottles carried by the inserts cannot come in contact with each other or rub against each other and the side and end walls. Thus, at each point where the cups or wells 91 are close to each other, there is at least a distance or spacing of ⅛" provided by a rib 98 formed by the walls of two adjacent cups or wells 91 as shown in FIGS. 3 and 5. The wells 91 also can be characterized as major wells and the recesses 97 as minor wells. Another reason for not using AFM cartons or containers is that AFM containers cannot run on a continuous in line machine which does all the scoring and slitting because of the longer minor flaps are required which necessitates the AFM blanks to go off of that machine and go onto a die cutting machine and thus in effect requiring a two-pass procedure. With the carton or box of the present invention, it is possible to stay on the primary converting machine providing additional savings.

The ⅛" spacing between the cups or wells 91 has been selected so that it corresponds to typically the thickness of separators which have heretofore been utilized for separating containers so that the same size boxes can be utilized with the half inserts of the present invention and without requiring the use of larger cartons while also serving to retain the bottles or containers out of contact with each other and the side and end walls of the carton.

It should be appreciated that the cups or wells 91 and the cylindrical upstanding portions 96 need not necessarily be limited to a cylindrical circular configuration. They can for example be square or hexagonal or different shapes depending on the size and shapes of the containers. The wells are arranged in an outer row 101 of three wells and an inner row 102 of three wells. In addition, the wells are arranged in such a pattern that when viewed in plan they can be visually viewed in groups of four with the two inside cups being shared to provide two groups of four for each half insert for a twelve container carton in which each half insert is adapted to receive six of the containers or bottles.

Docking pillars or posts are provided for each quadrant and thus as shown in FIG. 3 two docking posts 106 and 107 are provided. These docking posts 106 and 107 extend upwardly or outwardly from the first surface 87 and can take any desired form. For example they can take the form as shown of four-sided truncated pyramids having four inclined side walls 108 which adjoin each other and in which each wall faces in a direction towards the center of each of the wells or cups and terminating at a top or outer surface 109. The docking posts 106 and 107 can have a suitable height as for example one inch. Half docking posts 111 and 112 also provided as a part of each half insert and are associated with the wells in row 102 and are adapted to mate and cooperate with corresponding half docking posts 111 and 112 carried by the other half insert carried by the other flap.

Although the present invention has been described in connection with the inserts 81, 82, 83 and 84 being constructed so that they are can receive either tops or bottoms of containers, they also can be constructed so that they are specific to only tops or bottoms of containers.

Cartons for glass containers such as wine bottles and the like require the use of an AFM (all flaps meet) bottom which means that two minor flaps must meet to prevent excess travel of the glass containers in the center of the carton. Since typically the minor flaps of a carton do not meet with each other but have a space between the same in order to provide a level stable platform by use of the half inserts hereinbefore described, the inner row of three wells in each half insert is provided with arcuate depressed U-shaped recesses 116 which are formed in the bottom wall 93 of the wells 91 to cause the bottom wall to project downwardly from the second surface 88 to provide elevation elements or shoes 117. The elevation elements 117 are disposed adjacent the innermost margin of the half insert 81 and are positioned so that they are adapted to the seat within the space 121 and support the insert 81 between the minor tabs as shown in FIG. 1. Thus, it can be seen that the first and second inserts carried by the bottom minor tabs 21 and 22 will have a stable level base upon which to rest so as to provide a level platform for the containers to be carried thereby. Providing such elevator elements or shoes which enter the space 121 between the minor flaps makes it possible to save material in making the carton and in particular makes it possible to utilize the shorter minor flaps.

The docking posts 106 and 107 which are disposed between the sides and ends of each of the half inserts are provided with a cooperative securing means for removably engaging the lock tabs 66 and 67 carried by the minor flaps 21 and 22. Thus the docking post 106 is provided with a pair of slots 126 at the junctions of the walls 108. The slots 126 extend along the heights of the post and open in a direction which is aligned with the longitudinal axis of the half insert or, in other words, are perpendicular to lines running through the rows 101 and 102. Similarly, slots 127 are provided in the docking post 107 and also extend from the top to the bottom at the junctions of the walls 108 but face in the direction which is at right angles to the slots 126 or, in other words, at right angles to the longitudinal axis of the half insert and parallel to the lines running through the centers of the rows 101 and 102. These slots 126 and 127 in the half inserts 81 and 82 receive the lock tabs 66 and 67 as shown in FIG. 1 to cooperatively and removably secure the first and second bottom half inserts 81 and 82 to the minor bottom flaps 21 and 22 so that the bottom half inserts 81 and 82 move with the minor bottom flaps 21 and 22. The mushroom-like caps 69 of the lock tabs 66 and 67 extend over the ends of the slots 126 and 127 to removably retain the half inserts 81 and 82 on the minor flaps 21 and 22. However, the half inserts 81 and 82 can still be manually removed from the minor flaps by overcoming the frictional engagement between the lock tabs 66 and 67 and the half inserts 81 and 82. Inserting the lock tabs 66 and 67 into the slots 126 and 127 can be accomplished manually or alternatively can be accomplished automatically by the use of carton erecting machinery. When the first and second half inserts are mounted on the minor flaps 21 and 22 in this manner, it can be seen that when the flaps 21 and 22 are folded inwardly the two half inserts mate with each other to in effect provide a full insert for the carton which covers the bottom wall and provides space for twelve containers or bottles for a twelve container carton 11. The cooperative securing means provided by the lock tabs 66 and 67 and the slots 126 and 127 permits some relative movement between the minor flaps 21 and 22 and the half inserts 81 and 82 so that irregularities in the containers can be accommodated and still retain the desired spacing between the containers and the side walls of the carton 11.

The third and fourth top half inserts 83 and 84 are of the same construction as the first and second bottom half inserts 81 and 82 and are removably and cooperatively secured by lock tabs 66 and 67 to the minor top flaps 26 and 27. Thus some relative movement between the half inserts 81 and 82 and the flaps 26 and 27 can mirror nonconformities in containers such as bottles while still retaining the desired spacing between the containers and the side walls of the carton.

Operation and use of the carton 11 and the half inserts 81–84 for use in performing the method of the present invention may now be briefly described as follows.

Let it be assumed that it is desired to form a carton blank 31 as shown in FIG. 2 from corrugated board stock. The carton blank can be formed in a conventional manner by use of a scoring and die cutting machine to provide the nine score or fold lines hereinbefore described, the six slots hereinbefore described and the eight die cut lock tabs 66 and 67 hereinbefore described. These steps can be performed in a single machine in an in-line process. The blank can then be supplied to a rotary printer to provide the appropriate printing to one side of the blank 31 after which the carton blanks can be stocked with the blind side up and warehoused in a flat condition until it becomes necessary to erect the carton blanks to form cartons or boxes 11.

Let it be assumed that the carton blanks are to be used for use by a winery for packaging wine bottles for shipment. The carton blanks can be shipped directly to the winery or can be shipped on pallets to a glass container manufacturer. The carton blanks 31 can then be loaded into magazines of a carton erector which forms the carton blank and applies glue lines 131 (see FIG. 3) to the minor bottom flaps 21 and 22 and another glue line 132 on the underside of the tab 41. The carton erector then folds side 1 and end 1 along the fold line 36 and at the same time end 1 and side 2 are folded along the fold line 37. End 2 is folded with respect to side 2 along fold line 38 and thereafter the tab 41 is bent along the fold line 42 and is bonded to side 1 by means of the adhesive 132. At this point there is provided a rectangular four-sided container which is open at the top and bottom. The molded pulp half inserts 81, 82, 83 and 84 are brought into interior of the four-sided open ended container and at the same time, the lock tabs 66 and 67 are pushed inwardly and are mated with the docking posts 106 and 107 by extending through the slots 126 and 127 provided in the docking posts 106 and 107 so that the inserts are thereafter carried by the minor tabs and are removably secured thereto. Although these procedures have been described as being performed automatically by machinery, it should be appreciated that all these steps can be performed manually by hand if desired. It is also possible to place the inserts on the lock tabs prior to formation of the four-sided enclosure. However this would be more difficult when performed by machinery.

After the inserts 81–84 have been placed on the lock tabs 66 and 67 as hereinbefore described, the minor tabs 21 and 22 can be folded inwardly so they lie in a plane or are extended at 90° with respect to the side and end walls. Thereafter, the two major flaps 23 and 24 are folded inwardly over the minor flaps and are bonded thereto by the adhesive lines 131 carried by the minor flaps 21 and 22. After these steps have been completed, the completed box is ejected from the machine and is ready for loading with bottles. The lock tabs 66 and 67 are facing in a direction at 90° with respect to each other to prevent minor shifting which possibly could occur if the lock tabs were aligned with each other. By offsetting the tabs by 90° it is possible to prevent directional travel in either longitudinal or latitudinal directions.

Thereafter, the open ended carton can then be advanced into a carton loading machine which if at a glass manufacturer can be loaded with unfilled bottles for later shipment to the winery. For example, the bottles which may be unlabeled can be inserted with the necks down in which event, the necks or tops of the bottles would be guided by the docking posts 106 and 107 into the cylindrical recesses 97 provided by the cylindrical ribs 96. Alternatively, if the bottles are inserted with the bases bottom side down, the bases of the bottles would be guided by the docking posts to be seated within the cylindrical wells 91.

Thereafter, at the glass manufacturer, the minor flaps 26 and 27 could be folded inwardly with the inserts carried thereby coming into engagement with either the necks or the bases of the bottles in the carton depending upon the manner in which the bottles were loaded either right side up or right side down with the appropriate portions of the bottle, for example the necks seating in the recesses 97 of the cylindrical ribs 96, or conversely if the bases are facing upwardly with the bases seating within the cylindrical wells 91 (see FIG. 2). If the bottles are empty, it not necessary to seal the major upper flaps to the minor upper flaps. The cartons with the bottles can therein be shipped to the winery. The winery can then utilize machinery for emptying the bottles from the cartons. Thereafter, the bottles can be filled with wine, labeled and then reinserted into the cartons in a similar manner after which glue lines 133 can be applied to the minor top flaps 26 and 27. The major top flaps then can be folded over the minor flaps and bonded thereto to close the carton for shipment.

As can be seen in FIG. 1, when the bottles or containers are mounted in the carton 11 with the inserts 81–84 engaging the bases or bottoms of the bottles and the necks or tops of the bottles, the bottles are maintained out of engagement with each other and out of engagement with the side walls of the carton. Thus it can be seen that the molded pulp inserts utilized serve as platforms or trays and are attached to the minor flaps of a carton to maintain the spaced-apart positions for the bottles or containers with respect to each other and with respect to the side walls of the carton. Such an arrangement makes it possible to eliminate label scuffing which is a common problem caused by labels in contact with corrugated partitions and the box interior during movement of the bottles during shipment of the filled cartons. Such a carton with the containers requires less material and can be produced at a significantly lower cost. The use of the inserts with the elevator shoes provided on the same make it unnecessary to utilize AFM (all flaps meet) bottom cases or cartons. Since there is less material utilized in the carton, the weight is substantially reduced for example by as much as eight ounces for a twelve-bottle carton. The carton and the inserts can be made entirely of recycled material and they also can be recycled for future use.

Figure 7:
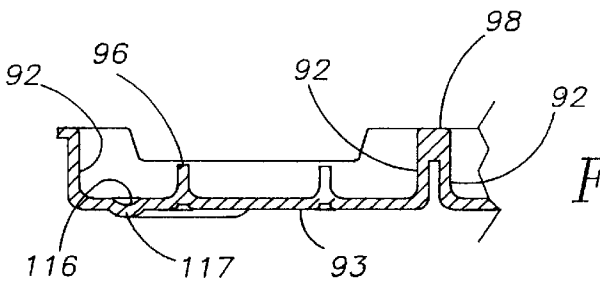
FIG. 7 is cross-sectional view taken along the lines 7—7 of FIG. 4.
Figure 8:
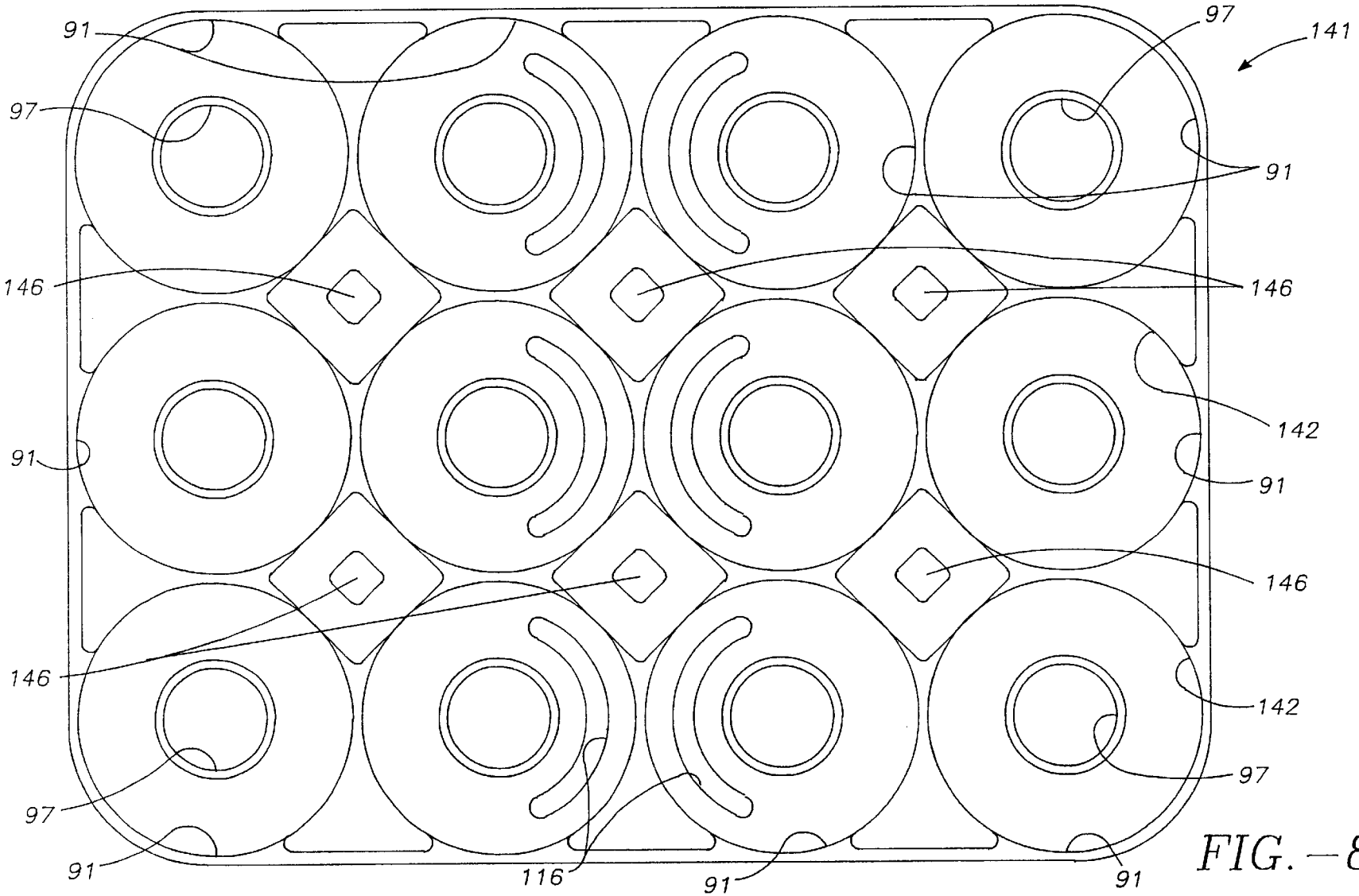
FIG. 8 is a top plan view of another insert incorporating the present invention which can cover the entire top or bottom side of a carton.
Figure 9:
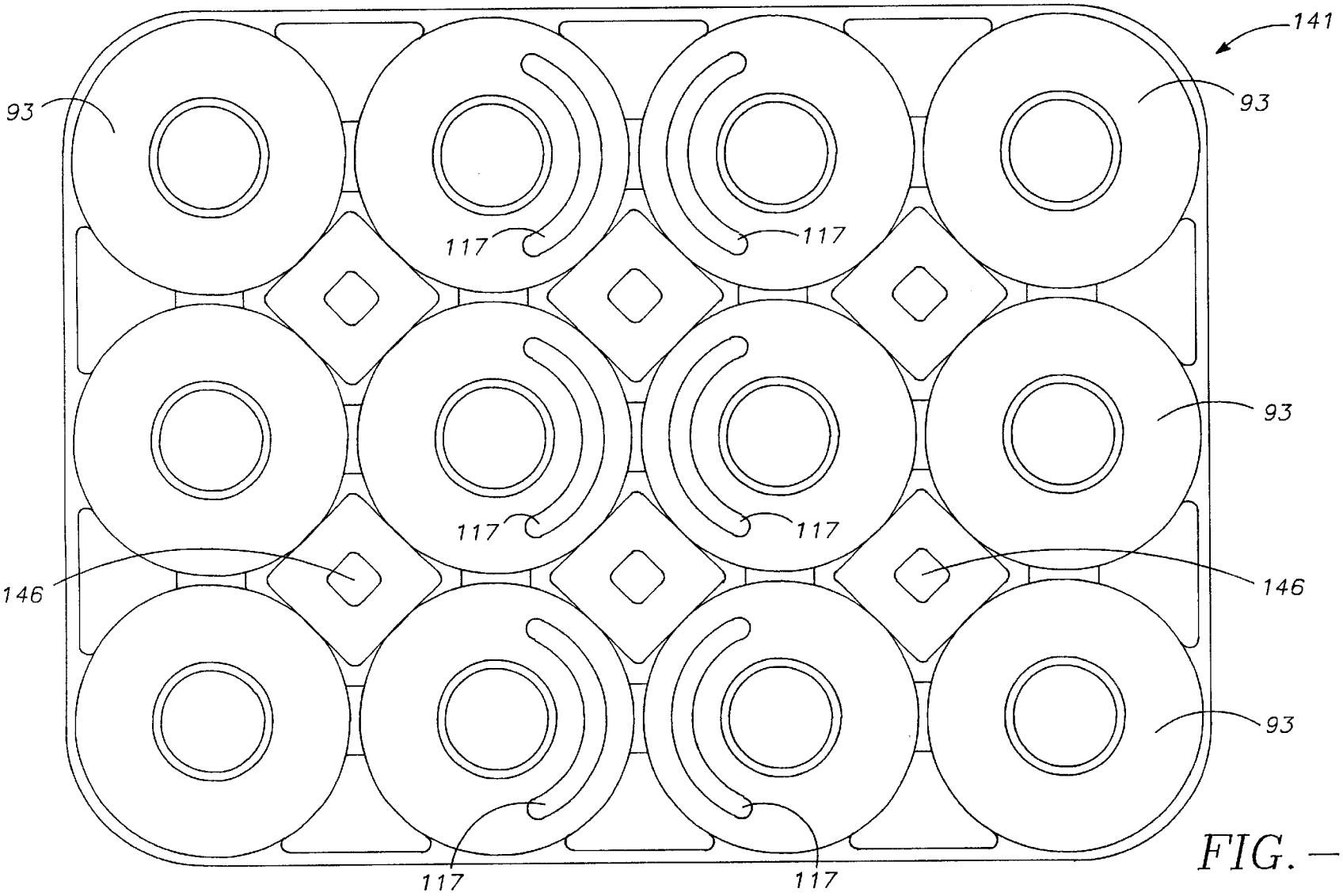
FIG. 9 is a bottom plan view of the insert shown in FIG. 7.

Although the invention thus far described has been principally directed to the use of inserts which are half inserts and in which two half inserts are required for each of the top and bottom sides of the carton or container, it should be appreciated as shown in FIGS. 7 and 8, that the two parts can be formed as a single part as an inset 141. The insert 141 is sized so that it can cover the entire top or bottom wall of a carton as for example a twelve-bottle container carton having twelve major wells 142 aligned in four rows of three wells looking in one direction or three rows of four wells looking in another direction and corresponding to the six wells provided in each of the half inserts hereinbefore described. Also provided within the major wells 142 are centrally located minor wells 143.

These inserts 141 can be utilized in a similar manner with cartons of the type hereinbefore described. After the carton has been erected and the bottom side has been closed, an insert 141 can be placed within the container so it rests against the bottom wall after which containers or bottles can, be loaded therein, with the bottles appropriately seated in either the minor wells or the major wells depending upon whether the base or the neck of the bottle is facing downwardly. After the carton or case has been filled or at least partially filled with bottles or other insert 141 can be placed over the top of the bottles engaging either the necks or the bases of the bottles depending upon whether the bottles have been inserted into the carton right side up or upside down. Thereafter, the minor flaps can be folded over the insert 141 followed by the major flaps and adhering the major flaps to the minor flaps to complete the packing procedure. With such an arrangement it can be seen that the bottles are maintained out of engagement with each other and out of engagement with the side walls of the container to obtain the advantages hereinbefore described for a carton utilizing half inserts.

What is claimed:

1. A combination of a carton and a plurality of containers, the carton comprising first and second parallel spaced-apart side walls, first and second parallel spaced-apart end walls adjoining the first and second side walls to form a four sided enclosure having a bottom side and a top side, major flaps carried by the first and second side walls and minor flaps carried by the first and second end walls forming a bottom wall closure extending over the bottom side, major flaps carried by the first and second side walls and minor flaps carried by the first and second end walls extending over the top side forming a top closure to provide a six-sided enclosed space, a first insert formed of a non-plastic material disposed in the enclosed space and extending substantially continuously over the bottom closure and being supported by the bottom closure, said plurality of containers being disposed within the enclosed space and engaging the first insert, a second insert formed of a non-plastic molded pulp material disposed in the enclosed space and extending substantially continuously underneath the top closure and overlying the containers and engaging the containers, said first and second inserts including means engaging the tops and bottoms of the containers and for retaining the containers in spaced-apart positions out of engagement with each other and in spaced-apart positions with respect to the first and second side walls and the first and second end walls thereby preventing engagement of the containers with respect to each other and with respect to the first and second side walls and the first and second end walls of the carton during movement of the carton with the containers therein, said second insert being formed of two half sections, the combination further including securing means for removably securing each of said half sections to a minor flap of the top closure including a lock tab formed as a part of the minor flap and being bent out of the plane of the minor flap and cooperatively and removably engaging the half section so that the half section moves substantially in accordance with the movement of the minor flap.

2. A combination as in claim 1 wherein said securing means is formed to permit some relative movement between the lock tabs of the minor flaps and the half inserts.

3. A combination as in claim 2 wherein said securing means includes slots formed in the half sections and having the lock tabs of the minor flaps extending through the slots.

4. A combination as in claim 3 wherein said lock tabs extend in directions which are substantially perpendicular to the plane of the minor flaps.

5. A combination as in claim 4 wherein said lock tabs are substantially mushroom-shaped in elevation and have side portions extending beyond the slots to retain the lock tabs in the slots.

6. A combination as in claim 1 wherein said first insert is formed in two half sections and further including securing means for removably securing the half sections of the first insert to the minor flaps of the bottom closure.

7. A combination of a carton and a plurality of containers, the carton comprising first and second spaced-apart side walls, first and second parallel spaced-apart end walls adjoining the first and second side walls to form a four-sided enclosure having a bottom side and a top side, means forming a bottom wall closure extending over the bottom side, said means including first and second minor flaps secured to the first and second end walls and first and second major flaps secured to the first and second side walls, first and second half inserts formed of a non-plastic material and cooperative securing means removably securing said first and second half inserts to said first and second minor flaps so that when the minor flaps are folded inwardly over the bottom side, the first and second half inserts are carried with the first and second minor flaps and face into said four-sided enclosure, means securing the major flaps to the minor flaps after the major flaps have been folded inwardly over the bottom side of the first and second minor flaps, means extending over the top side forming a top closure, said means forming the top closure including third and fourth minor flaps secured to the first and second end walls and third and fourth major flaps secured to the first and second side walls, third and fourth half inserts formed of a non-plastic material, cooperative securing means removably securing said third and fourth half inserts to said third and fourth minor flaps so that when the third and fourth minor flaps are folded inwardly over the top side, the third and fourth half inserts are carried with the third and fourth minor flaps and face into said four-sided enclosure, means securing the third and fourth major flaps to the third and fourth minor flaps after the third and fourth minor flaps have been folded inwardly and the third and fourth major flaps have been folded over the third and fourth minor flaps, a plurality of containers having tops and bottoms disposed within the enclosed space, said first and second and third and fourth inserts having means for engaging said bottoms and said tops of the containers for holding the containers in positions so that they are spaced apart from each other and are also spaced apart from the side and end walls to prevent engagement of the containers with respect to each other and with respect to the first and second side walls and the first and second end walls of the carton during movement of the carton with the containers therein.

8. A combination as in claim 7 wherein said cooperative securing means is formed to permit relative movement between the minor flaps and the half inserts.

9. A combination as in claim 7 wherein said half inserts are formed of molded pulp.

10. A method for packaging a plurality of containers in a carton with a plurality of half inserts, the carton having a space defined by first and second spaced-apart parallel sidewalls and first and second spaced-apart parallel end walls adjoining the side walls and having top and bottom minor flaps adjoining the end walls and top and bottom major flaps adjoining the side walls, the method comprising removably securing a half insert to each of the first and second bottom minor flaps so that the half inserts move with the first and second bottom minor flaps as the first and second bottom minor flaps are moved, folding the first and second bottom minor flaps inwardly so that the half inserts carried thereby face inwardly into the space through the bottom side for receiving the containers to be placed in the carton and folding the first and second bottom major flaps inwardly over the bottom minor flaps and bonding the first and second bottom major flaps to the first and second bottom minor flaps to form a bottom closure for the carton.

11. A method as in claim 10 further including the steps of removably securing half inserts to the first and second minor top flaps so that the half inserts move with the first and second minor top flaps.

12. A method as in claim 11 further including the steps of placing the containers in the space and seating the containers on the half inserts secured to the bottom minor flaps, folding the first and second top flaps over the containers so that the half inserts carried thereby face inwardly into the space through the top side to engage the containers, folding the first and second major top flaps over the first and second minor top flaps and bonding the first and second major top flaps to the first and second minor top flaps to form a top closure for the carton, the engagement of said half inserts carried by the first and second minor top flaps with the containers and first and second minor bottom flaps with the containers serving to retain the containers out of engagement with each other and out of engagement with the sidewalls of the carton.

13. A method for packing a plurality of containers in a carton with a plurality of half inserts, the carton having a space defined by first and second spaced-apart parallel side walls and first and second spaced-apart parallel end walls adjoining the side walls and having top and bottom minor flaps adjoining the end walls and top and bottom major flaps adjoining the side walls, the method comprising removably securing a half insert to each of the first and second top minor flaps so that the half inserts move with the first and second top minor flaps as the first and second top minor flaps are moved, folding the first and second top minor flaps inward so that the half inserts carried thereby face inwardly into the space through the top side to engage containers which have been placed in the carton and folding the first and second top major flaps inwardly over the top minor flaps and bonding the first and second top major flaps to the first and second top minor flaps to form a top closure for the carton.

14. A combination of a carton and a plurality of containers, the carton comprising first and second spaced-apart side walls, first and second parallel spaced-apart end walls adjoining the first and second side walls to form a four-sided enclosure having a bottom side and a top side, means forming a bottom wall closure extending over the bottom side, means forming a top wall closure extending over the top side, at least one of said bottom wall closure and said top wall closure including first and second minor flaps secured to the first and second end walls and first and second major flaps secured to the first and second side walls, first and second half inserts formed of a non-plastic material and cooperative securing means removably securing said first and second half inserts to said first and second minor flaps of one of said means forming a bottom wall closure and said means forming a top wall closure so that when the minor flaps are folded inwardly, the first and second half inserts are carried with the first and second minor flaps and face into said four-sided enclosure.

* * * * *